US007617813B2

(12) United States Patent
Pirkl et al.

(10) Patent No.: US 7,617,813 B2
(45) Date of Patent: Nov. 17, 2009

(54) METHOD FOR CONTROLLING A PIEZOELECTRIC ACTUATOR AND CONTROL UNIT FOR CONTROLLING A PIEZOELECTRIC ACTUATOR

(75) Inventors: Richard Pirkl, Regensburg (DE); Harald Schmidt, Vienna (AT); Hans-Jörg Wiehoff, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 345 days.

(21) Appl. No.: 11/721,013

(22) PCT Filed: Nov. 25, 2005

(86) PCT No.: PCT/EP2005/012642

§ 371 (c)(1),
(2), (4) Date: Jun. 6, 2007

(87) PCT Pub. No.: WO2006/061113

PCT Pub. Date: Jun. 15, 2006

(65) Prior Publication Data

US 2009/0223490 A1 Sep. 10, 2009

(30) Foreign Application Priority Data

Dec. 8, 2004 (DE) ..... 10 2004 058 971

(51) Int. Cl.
*F02M 51/00* (2006.01)

(52) U.S. Cl. ..... 123/490; 123/478

(58) Field of Classification Search ..... 123/478, 123/490; 361/154

See application file for complete search history.

(56) References Cited

U.S. PATENT DOCUMENTS

| | | | | |
|---|---|---|---|---|
| 6,102,008 | A * | 8/2000 | Maeda et al. | 123/490 |
| 6,619,268 | B2 * | 9/2003 | Rueger et al. | 123/490 |
| 6,879,087 | B2 * | 4/2005 | Moler | 310/328 |
| 6,928,986 | B2 * | 8/2005 | Niethammer et al. | 123/467 |
| 6,978,770 | B2 * | 12/2005 | Rauznitz et al. | 123/498 |
| 7,131,429 | B2 * | 11/2006 | Dietl et al. | 123/490 |
| 7,275,522 | B2 * | 10/2007 | Beilharz et al. | 123/490 |
| 2001/0027780 | A1 * | 10/2001 | Rueger et al. | 123/498 |

(Continued)

FOREIGN PATENT DOCUMENTS

EP 1418328 5/2004

(Continued)

OTHER PUBLICATIONS

International Search Report PCT/EP2005/012642, 6 pages, Mar. 17, 2006.

(Continued)

*Primary Examiner*—Erick Solis
(74) *Attorney, Agent, or Firm*—King & Spalding L.L.P.

(57) ABSTRACT

A method for controlling a piezoelectric actuator which displaces a control element of an injection valve includes the step of charging the actuator until a start voltage is reached. Subsequently, the actuator is discharged until a partial lifting voltage, which is maintained during a holding time, is reached. In the final step, the actuator is discharged until an off-load voltage is reached and a parameter which is dependent on the partial lifting voltage is used as a control variable. A desired value for the control variable is determined and the actuator is controlled in such a manner that the desired value of the control variable is maintained.

18 Claims, 6 Drawing Sheets

U.S. PATENT DOCUMENTS

2002/0000218 A1 * 1/2002 Rueger et al. ..... 123/498

FOREIGN PATENT DOCUMENTS

| | | |
|---|---|---|
| EP | 1489291 | 12/2004 |
| WO | 0068558 | 11/2000 |
| WO | 03067073 | 8/2003 |
| WO | 2005061876 | 7/2005 |

OTHER PUBLICATIONS

Written Opinion of the International Searching Authority (Supplementary Sheet) PCT/EP2004/012642, 3 pages.
International Search Report with Written Opinion PCT/EP2005/012642, 11 pages, Mar. 17, 2006.

* cited by examiner

METHOD FOR CONTROLLING A PIEZOELECTRIC ACTUATOR AND CONTROL UNIT FOR CONTROLLING A PIEZOELECTRIC ACTUATOR

CROSS-REFERENCE TO RELATED APPLICATIONS

This application is a U.S. national stage application of International Application No. PCT/EP2005/012642 filed Nov. 25, 2005, which designates the United States of America, and claims priority to German application number 10 2004 058 971.2 filed Dec. 8, 2004, the contents of which are hereby incorporated by reference in their entirety.

TECHNICAL FIELD

The invention relates to a method for controlling a piezoelectric actuator and to a control unit for controlling a piezoelectric actuator.

BACKGROUND

Piezoelectric actuators are used in a wide variety of technical fields to activate a final controlling element. In particular piezoelectric actuators are suitable for activating an on-off valve of a pump-nozzle unit of a fuel injection system. Piezoelectric actuators can be switched very quickly, so the injection processes of the pump-nozzle unit can be precisely controlled.

Modern pump-nozzle units with which, for example, diesel is injected into an internal-combustion engine of a motor vehicle, use high fuel pressures of up to 2,000 bar. In addition exhaust gas quality requirements are constantly increasing, so very precise adjustment of the injected quantity of fuel and equalization of the quantity injected into different cylinders of an internal-combustion engine are required. The precise injection processes should also be adhered to throughout the life of the pump-nozzle unit even in the case of corresponding ageing phenomena. Tolerances that occur in the case of pump-nozzle units should also be compensated.

These objectives require precise regulation of the pump-nozzle units. In particular the hydraulic cut-off of the pump-nozzle unit, which may be derived from the opening behavior of the piezoelectric actuator, should be determined as precisely as possible for this purpose. Knowledge of the instant of hydraulic cut-off of the pump-nozzle unit is necessary to ensure minimum quantity stability owing to relatively high injection sensitivity during the charging process of the piezoelectric actuator, as is knowledge of its hysteresis behavior. Knowledge of the instant of hydraulic cut-off of the pump-nozzle unit is also necessary for cylinder-individual correction.

Since in the case of injection valves there is in general no position measuring at the injection valve however, the opening behavior of the injection valve is determined from the voltage of the piezoelectric actuator. Various control methods are known for this purpose.

SUMMARY

There exists a need for an improved method for controlling a piezoelectric actuator and an improved control unit for controlling a piezoelectric actuator.

According to an embodiment, a method for controlling a piezoelectric actuator which moves a control valve of an injection system, comprises the steps of charging the actuator firstly to a starting voltage in order to start an injection via the control valve, subsequently discharging the actuator in order to end the injection via the control valve, wherein the actuator is discharged to a partial lifting voltage during discharging in order to execute a partial lifting control of the control valve and discharging is interrupted during a holding time once the partial voltage is reached, and discharging the actuator to an off-load voltage, wherein a parameter that is dependent on the partial lifting voltage of the actuator during the holding time is used as the desired value for controlling the actuator, and wherein the actuator is activated according to the desired value in order to regulate a partial lift of the control valve.

According to an embodiment, a control unit for controlling a piezoelectric actuator is connected to a measurement set-up, wherein the measurement set-up detects the voltage at the actuator, wherein the control unit is connected to a charging unit which influences a charge and/or voltage of the actuator, and wherein the control unit is operable to charge the actuator firstly to a starting voltage in order to start an injection via the control valve, to subsequently discharge the actuator in order to end the injection via the control valve, wherein the actuator is discharged to a partial lifting voltage during discharging in order to execute a partial lifting control of the control valve and discharging is interrupted during a holding time once the partial voltage is reached, and to discharge the actuator to an off-load voltage, wherein a parameter that is dependent on the partial lifting voltage of the actuator during the holding time is used as the desired value for controlling the actuator, and wherein the actuator is activated according to the desired value in order to regulate a partial lift of the control valve.

BRIEF DESCRIPTION OF THE DRAWINGS

The invention will be described in more detail hereinafter with reference to the figures, in which.

DETAILED DESCRIPTION

One advantage of the method according to an embodiment lies in the fact that a parameter that is dependent on the partial lifting voltage is used as the control variable, and in that a desired value is established for the control variable with which the method for controlling the piezoelectric actuator is carried out.

In a further embodiment the gradient of the voltage during the discharge time is used as the control variable. Individual adjustment of the control method is thus made possible.

In a further embodiment a value range is used as the desired value for the partial lifting voltage. Stipulating a value range for the partial lifting voltage provides precise control of the final controlling element, in particular control of a switch needle of an injection valve, in particular of a pump-nozzle unit or a common rail injection valve. In a further embodiment a maximum voltage value for the partial lifting voltage is used as the desired variable. Tests have shown that using a maximum voltage value for the partial lifting voltage results in relatively precise and efficient regulation of the control method.

In a further embodiment the partial lifting voltage is used as the control variable and the gradient of the partial lifting voltage as the desired value. This results in a further improvement in the control method.

The described method is particularly suitable when used in a common rail injection valve or a pump-nozzle unit of a fuel injection system. The voltage values of the actuator are preferably detected during a test activation of the actuator during which no injection takes place and only measured values are determined. The injection mode is thus not affected by detection of the measured values.

In a further embodiment the partial lifting voltage is used as the parameter and a frequency of the partial lifting voltage is pre-defined as the desired variable. Tests have shown that the frequency of the partial lifting voltage is suitable for precise control of the piezoelectric actuator.

The various possible embodiments will be described using the example of a pump-nozzle unit but can be used with any type of injection valve, in particular with a common rail injection valve.

Figure 1:
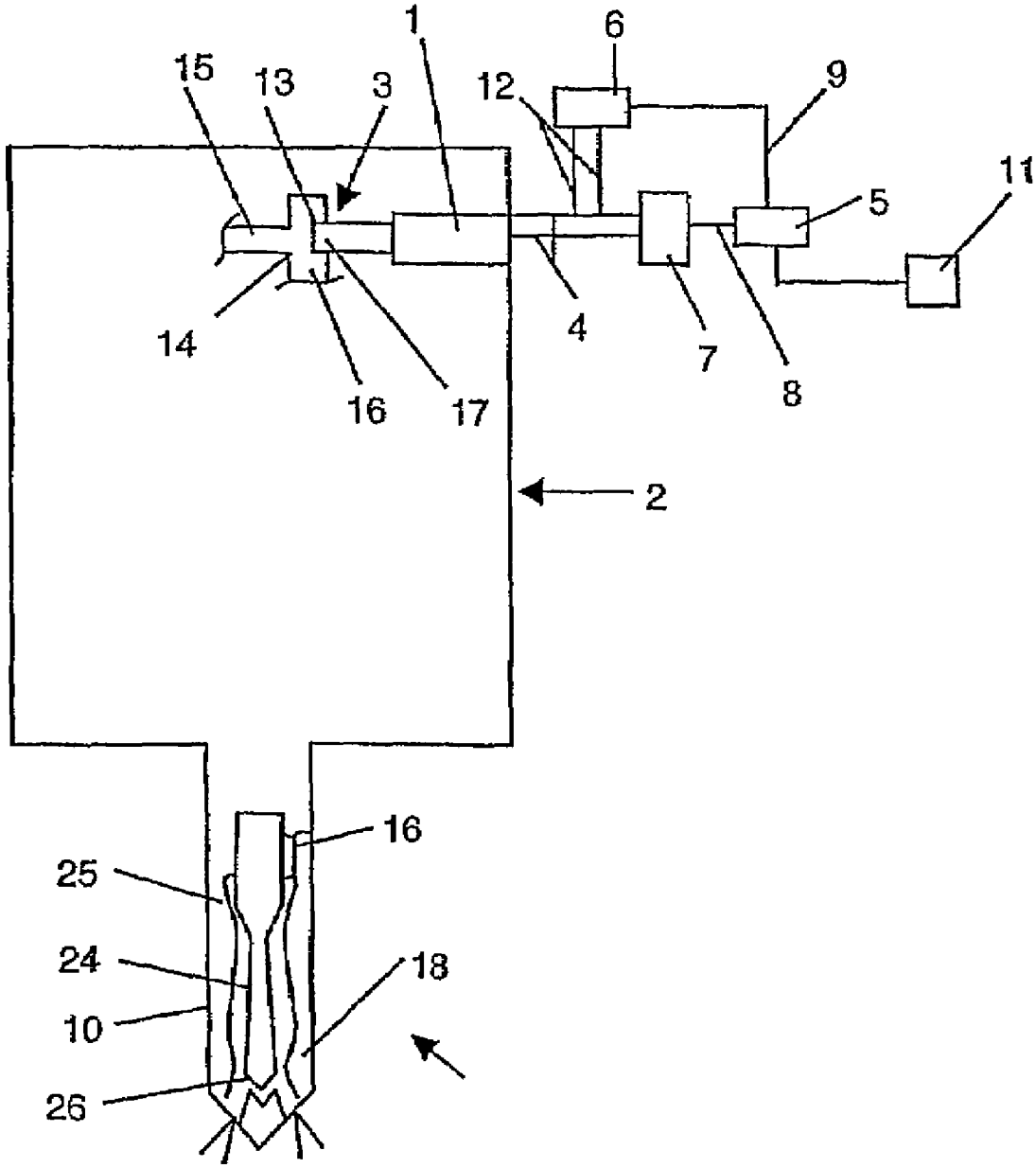
FIG. 1 shows a schematic arrangement for carrying out the method according to an embodiment.

FIG. 1 shows in a schematic diagram an arrangement comprising a pump-nozzle unit 2 which is connected to a measurement set-up 6 and a control unit 5. The pump-nozzle unit 2 is an injection valve for example for an internal-combustion engine of a motor vehicle, the injection processes of which are controlled using a piezoelectric actuator 1. In the illustrated embodiment the piezoelectric actuator 1 controls a control valve 3 which controls a position of a nozzle needle of the pump-nozzle unit 2 via a hydraulic connection. The nozzle needle is lifted from a sealing seat and an injection triggered as a function of the position of the control valve 3. The basic construction of the pump-nozzle unit 2 is known and will not be described in more detail in the present application. The control valve 3 comprises a sealing face 13 with which a sealing seat 14 is associated. The sealing face 13 is constructed on an end face of a control valve needle 17 of the control valve 13. The sealing seat 14 is annularly arranged around an inlet aperture of an admission 15. The admission 15 is connected to a fuel reservoir. The pump-nozzle unit comprises an injection nozzle 10 with a pressure chamber 25 in which a nozzle needle 24 is arranged. The injection nozzle 10 comprises injection holes 18 via which fuel is released from the pressure chamber 25 in the injection process. The admission 15 ends via the inlet aperture in a connecting line 16 which is connected to a pump chamber of a pump and the pressure chamber 25 of the pump-nozzle unit. The nozzle needle 24 is arranged in the pressure chamber 25 with pressure surfaces. The nozzle needle 24 is lifted from an associated needle sealing seat 26 as a function of pressure in the pressure chamber 25 and injection takes place.

The piezoelectric actuator 1 is connected by electric lines 4 to a charging unit 7. The charging unit 7 is connected to the control unit 5 by a control line 8. The control unit 5 is also connected to a memory 11. The measurement set-up 6 is also connected to the electric lines 4 by first measuring leads 12. The measuring set-up 6 is also connected to the control unit 5 by a second measuring lead 9.

The control unit 5 activates the charging unit 7 in such a way that the piezoelectric actuator 1 controls the control valve 3 in the desired manner, so the nozzle needle 24 is lifted from the needle sealing seat 26 at fixed times and releases fuel from the pressure chamber 25 via the injection holes 18. In particular regulation of the cut-off, i.e. closing of the injection holes, is of particular importance to the quality of injection. Established control methods are stored in the memory 11 for this purpose, according to which methods the control unit 5 activates the charging unit 7 to attain defined partial lifts of the actuator 1, in particular during regulation of the cut-off. To regulate the control method the voltage applied to the piezoelectric actuator 1 is detected via the electric lines 4 by way of the measurement set-up 6 and is communicated to the control unit 5 via the second measuring lead 9. As a function of the detected voltage and comparison with voltage values stored in the memory 11 the control unit 5 adjusts activation of the charging unit 7 in order to attain the desired voltage characteristic at the actuator 1. The voltage characteristic at the actuator 1 fixes the partial lift of the piezoelectric actuator, in particular in the case of the cut-off, and thus fixes the injection characteristic of the pump-nozzle unit 2.

Figure 2:
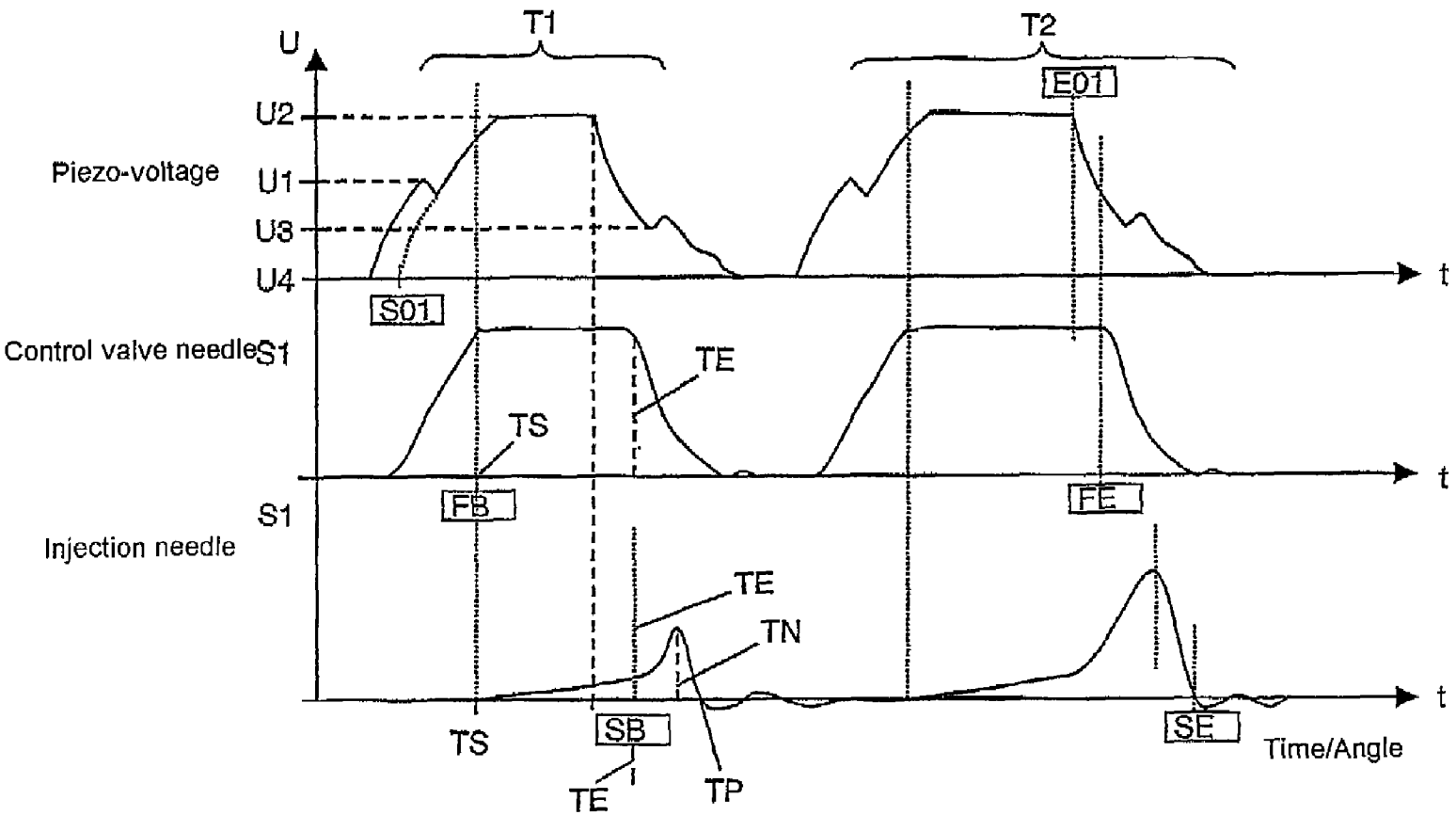
FIG. 2 shows a schematic graph to illustrate an injection sequence with pre-injection and main injection.

FIG. 2 shows a graph for a typical injection characteristic of an injection valve, in particular a pump-nozzle unit 2 with a pre-injection and a main injection. The uppermost graph line plots the piezo-voltage, i.e. the voltage applied to the piezoelectric actuator 1, over time or the crankshaft angle. The piezo-voltage is detected by way of the measuring set-up 6 via the electric lines 4. A first time segment T 1 illustrates the pre-injection and a following, second time segment T 2 the main injection. In the case of pre-injection the piezo-voltage is first increased to a first voltage value U 1 and subsequently, following a brief drop, increased to a second voltage value U 2 which is greater than the first voltage value U 1. The second voltage value U2 is a starting voltage. After a fixed period the voltage is reduced from the second voltage value U 2 to a third voltage value U 3 and after a brief increase in voltage is finally reduced to a fourth voltage value U 4 which is less than the third voltage value U 3. The voltage between the third and fourth voltage values U 3, U 4 is a partial lifting voltage. Partial lifts of the piezoelectric actuator 1 are adjusted by the different voltage values.

Under piezo-voltage FIG. 2 plots the position of the control valve needle 17 over time or the crankshaft angle. The position of the control valve needle 17 depends on the piezo-voltage. Pre-defining the partial lifting voltages predefines partial lifts of the control valve needle 17. In addition the partial lifting voltage is proportional to a needle lift or a position of the control valve needle 17 of the control valve 3. The partial lifting voltage may thereby be used as a control variable for regulations of partial lifts of the control needle 17, in particular in the case of injection cut-off. The bottom graph line plots the position of the nozzle needle 24 over time or the crankshaft angle.

At an instant TS the position of the control valve needle 17 attains the maximum excursion which corresponds to positioning of the control valve needle 17 with sealing face 13 on the sealing seat 14. At this instant the admission 15 is closed. Since at this instant the pump of the pump-nozzle unit 2 seals the fuel situated in the pump chamber, the pressure in the pressure chamber 25 and at the pressure surfaces of the nozzle needle 24 increases, so at instant TS the nozzle needle 24 is lifted from the needle sealing seat 26, as may be seen from the lower graph. The injection process thus starts at instant TS. With a delay in relation to lowering of the piezo-voltage from the second voltage value U 2 to the third voltage value U 3, at instant TE the control valve needle 17 starts to rise again from the sealing seat 14. Owing to the inertia of the system the nozzle needle 24 attains its maximum opening lift at a later instant TN in order to subsequently settle on the needle sealing seat 26 again at an instant TP. Owing to the inertia of the system, for accurate injection control it is necessary for the control valve needle 17 to be activated in partial lifts in order to precisely control the nozzle needle 24. This is particularly necessary as injection ends, i.e. on settling of the nozzle needle 24 on the needle sealing seat 26.

Activation of the piezoelectric actuator 1, which corresponds to a main injection, is carried out in the second time segment T2. The fundamental difference between pre-injection and main injection lies in the fact that the period in which the second voltage U2 is applied to the piezoelectric actuator 1 is longer than in the case of pre-injection. The nozzle needle is thereby lifted from the sealing seat for longer and more fuel is injected.

Owing to the inertia of the system precise activation of the piezoelectric actuator is required to adjust a precise quantity of fuel, which is release by the pump-nozzle unit 2. The hydraulic cut-off of the pump-nozzle unit, which may be derived from the opening behavior of the control valve 3, should be determined as accurately as possible for this purpose. To ensure minimum quantity stability it is necessary owing to the relatively high injection sensitivity during the discharge process of the piezoelectric actuator 1, which in the illustrated embodiment corresponds to opening of the control valve 3 and therewith to completion of the injection process, and owing to the hysteresis behavior of the piezoelectric actuator to precisely regulate the hydraulic cut-off of the pump-nozzle unit. The cut-off is fixed by the discharging process of the actuator, so the discharging process should be precisely controlled via partial lifts of the voltage. Cylinder-individual regulation of the cut-off of the pump-nozzle unit is preferably provided if a plurality of pump-nozzle units is provided in an internal-combustion engine for one cylinder in each case. The charging process of the actuator can also be regulated in partial lifts as a function of the embodiment, if a control valve 3 is used which is closed when there is no current flowing through the actuator 1, and injection is ended by the charging process of the actuator 1.

Since there is no distance measurement of the position of the control valve 3, the opening time and/or the opening behavior of the control valve is approximately determined from the voltage curve of the voltage applied to the piezoelectric actuator 1 in order to thus obtain a control variable for control of the cut-off of the pump-nozzle unit. 1

The cut-off of the pump-nozzle unit 1 is characterized in that after lifting the control valve needle 17 from the associated sealing seat the opening cross-section of the control valve 3 is increased, so a pressure-reduction phase may be established in the fuel system of the pump-nozzle unit 3. To a large extent the opening phase of the control valve 3 determines the minimum quantity stability. The opening phase of the control valve affects the temporal range in which the voltage at the piezoelectric actuator 1 is reduced from the second voltage U2 by way of the third voltage U3 to the fourth voltage U4.

In the opening phase of the control valve 3 the movement of the control valve needle 17 is substantially determined by the discharge gradient, i.e. the change in voltage at the piezoelectric actuator 1, by the applied valve sealing force, by the effect of the restoring spring (not shown) of the control valve needle 17 and by the resulting pressure pulse. The movement characteristic of the control valve needle 17 may be described in this connection by a higher order parabolic function. If during lifting the control valve needle 17 attains an opening stop (not shown) or if the control valve needle 17 is arrested by an electric holding time during the discharging process, the inherent parameters of the piezoelectric actuator 1 change as a result of the piezoelectric effect owing to the positive connection between the piezoelectric actuator 1 and the mechanical section of the control valve 3. An increase or a change in the characteristic shape may then be found during the course of the piezo-voltage and in piezo-charge.

Figure 3:
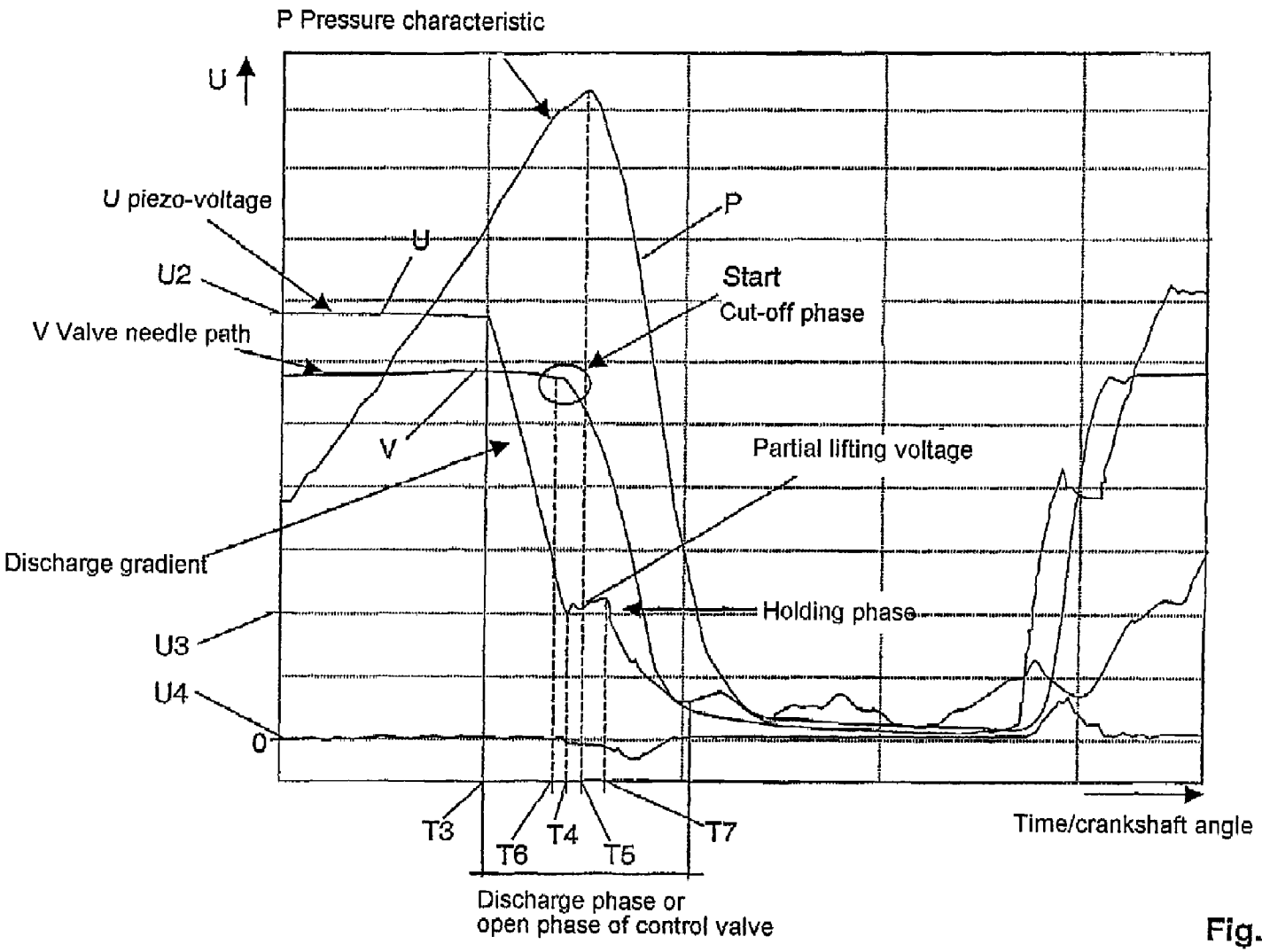
FIG. 3 shows a detailed view of a control valve opening phase of a pump-nozzle unit.

FIG. 3 shows in an enlarged graph the piezo-voltage U, the valve needle path V of the control valve needle 17 and the pressure characteristic P of the fuel in the pressure chamber 25 during the opening phase of the control valve 3, i.e. on introduction of the end of injection, i.e. the cut-off of the pump-nozzle unit 2. The characteristics are plotted over time or the crankshaft angle. From a third instant T 3 onwards discharging of the piezoelectric actuator 1 is carried out by the control unit 5 of the charging unit 7 according to activation, so the voltage U falls from the second voltage value U2 by way a discharge gradient to the third voltage value U3. Owing to the inertia the control valve needle 17 is delayed and is only lifted from the sealing seat 14 at a fourth instant T 4. Owing to the inertia of the system the fuel pressure P in the pressure chamber 25 attains the maximum pressure value at a fifth instant T 5 which is situated after the fourth instant T 4.

The third voltage value U 3 is attained at a sixth instant T 6. After the sixth instant T 6 there follows a holding phase which lasts until a seventh instant T 7 in which the charging unit 7 does not influence the voltage at the piezoelectric actuator 1 any further. Owing to the piezoelectric effect the partial voltage increases slightly in the holding phase between the sixth instant and the seventh instant T 6, T 7. The voltage at the piezoelectric actuator 1 during the holding phase is called the partial lifting voltage. The partial lifting voltage, in particular the gradient of the partial lifting voltage, is proportional to the lift of the control valve needle 17. For this reason the partial lifting voltage can be used as a control parameter in order to control a partial lift of the control valve needle 17. From the seventh instant T 7 onwards the charging unit 7 lowers the electric voltage at the piezoelectric actuator 1, by way of a discharging process, to the fourth voltage value U 4 which in the illustrated exemplary embodiment corresponds to the valve 0 volt.

Figure 4:
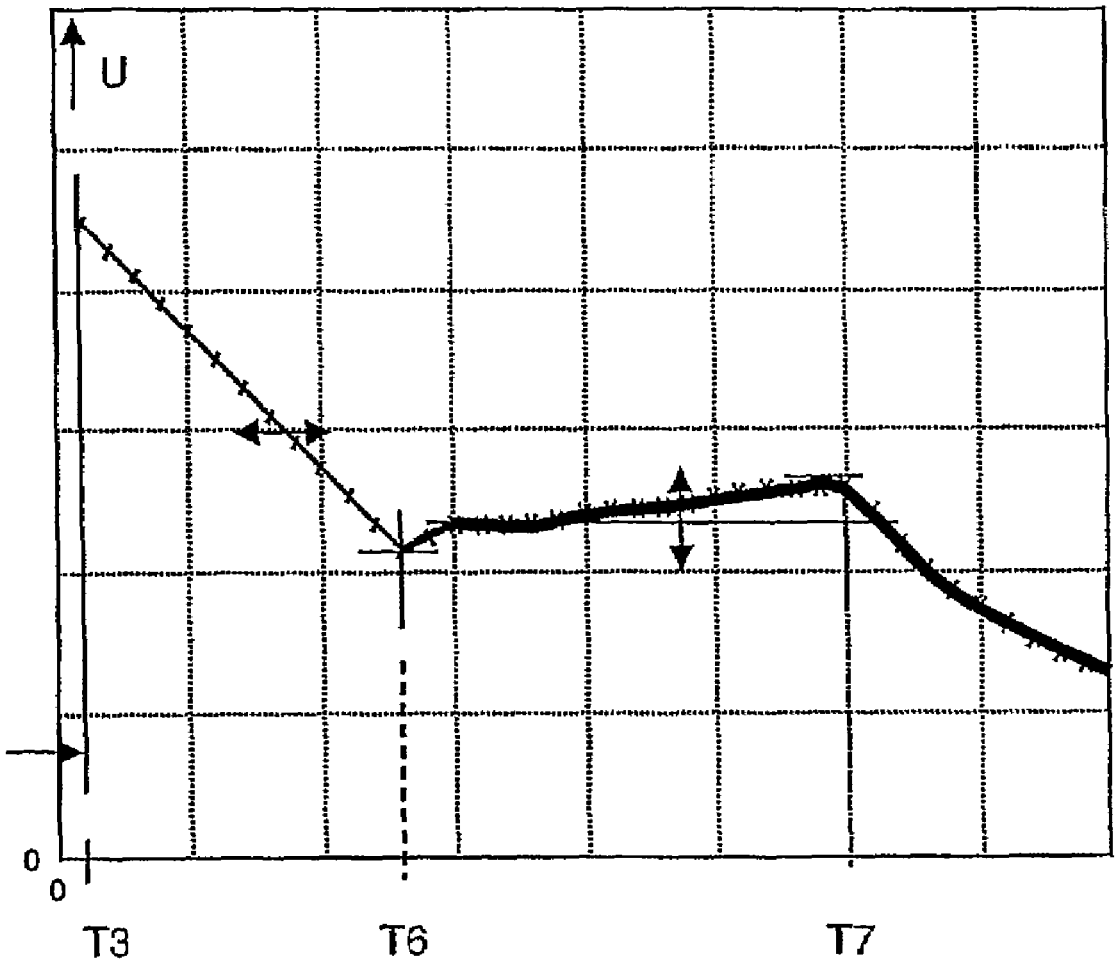
FIG. 4 shows a detailed view of the voltage characteristic during a gradual shutoff-holding phase.

FIG. 4 shows a detail of the piezo-voltage between the third instant T 3 and the seventh instant T 7.

Tests have shown that precise control of the pump-nozzle unit 2 is attained in that the discharge gradient between the second voltage U 2 and the third voltage U 3 is predefined as a cylinder-individual manipulated variable for controlling and/or regulating partial lifts of the control valve needle 17. Instead of the discharge gradient, the energy to be taken from the piezoelectric actuator 1 by the charging unit 7 between the third and the sixth instants T 3, T 6, or the energy gradient may also be used. These manipulated variables are therefore stored for each pump-nozzle unit by appropriate control programs in the memory 11.

An improvement in activation of the pump-nozzle unit is also achieved by regulation of the partial lift control of the control valve needle 17. The regulation process preferably uses the gradient characteristic of the partial lifting voltage between the sixth instant T 6 and the seventh instant T 7 during the holding phase individually as a control variable for each pump-nozzle unit 2 of an internal-combustion engine with a plurality of pump-nozzle units. The corresponding control programs, with which the individual gradient characteristic of the partial lifting voltage of the piezoelectric actuator of the pump-nozzle unit 2 is achieved, are stored in the memory 11. The control unit 5 accesses the corresponding control programs and controls the charging unit 7 accordingly which executes a corresponding discharge of the piezoelectric actuator 1. The voltage applied to the piezoelectric actuator 1 and the gradient of the partial lifting voltage are therefore detected by the measurement set-up 6 and forwarded to the control unit 5 to regulate the pump-nozzle unit 2. The control unit 5 compares the measured gradients of the partial lifting voltage during the holding phase with a reference value stored for the pump-nozzle unit 2. In the case of an internal-combustion engine with a plurality of pump-nozzle units 2 an individual reference value is stored for each pump-nozzle unit 2. If the detected voltage gradient does not match the stored voltage gradient, a change in the activation of the piezoelectric actuator is carried out such that the actual voltage gradient of the partial lifting voltage at the actuator 1 approximates the voltage gradient stored in the memory 11. In a simple embodiment a maximum voltage value at the end of the holding phase is used as the control value to regulate the partial lifting voltage.

The discharge time, i.e. the time between the third and the sixth instants T 3, T 6, is preferably kept constant and the discharge gradient is changed to achieve the desired voltage at the sixth instant T 6. Tests have shown that regulation of the partial lifting voltage during the holding phase, i.e. between the sixth and the seventh instants T 6, T 7, achieves a precise injection characteristic of the pump-nozzle unit 2.

Figure 5:
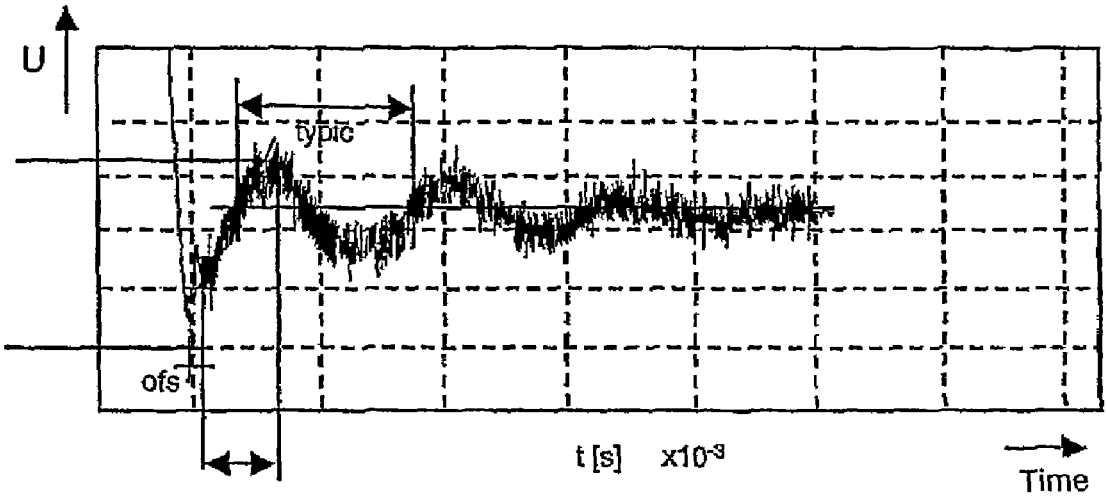
FIG. 5 shows the relaxation characteristic of the piezoelectric actuator during the partial lifting voltage.

FIG. 5 shows the partial lifting voltage U at the actuator 1 during the holding phase, the partial lifting voltage U having an oscillation spectrum. Tests have shown that the oscillation characteristic of the partial lifting voltage during the holding time may also be used as the control variable. The frequency or the amplitude of the partial lifting voltage is determined by the spring-mass characteristic of the control valve section in the pump-nozzle unit 2. The gradient of the partial lifting voltage and the amplitude characteristic of the partial lifting voltage can therefore be used as a control variable to control the pump-nozzle unit 2. When using the amplitude characteristic, corresponding comparative amplitude characteristics are stored in the memory 11 for the partial lifting voltage during the holding phase. For regulation the measurement set-up 6 detects the amplitude characteristic of the piezo-voltage during the holding phase and forwards this to the control unit 5. The control unit 5 compares the detected amplitude characteristic of the partial lifting voltage with the stored amplitude characteristic. The charging unit 7 is activated accordingly as a function of the difference in order to obtain an adjustment of the actual amplitude characteristic of the piezo-voltage during the holding phase to the comparative amplitude characteristic. The measured frequency is also compared with a comparative frequency in the same way and activation of the charging unit 7 is adjusted in such a way during the next holding phase that the measured frequency approximates the comparative frequency.

Correction of the opening time of the control valve or the cut-off of the pump-nozzle unit is achieved by a corresponding adjustment of the discharge energy on a preferably cylinder-individual basis and the resulting control system behavior. The resulting control system behavior is characterized in that the movement of the control valve needle 17 is influenced in such a way by a finely adjusted electric holding phase that the movement is significantly reproduced in the voltage or also in the piezo-charge. The discharge energy is accordingly adjusted until a desired reference characteristic of the amplitude of the voltage or a reference gradient of the voltage during the holding phase is established and therefore the opening behavior of the cut-off of the pump-nozzle unit can be controlled in a reproducible and cylinder-individual manner.

The measurement set-up 6 preferably detects the voltage applied to the piezoelectric actuator 1 during a standardizing pulse in which the piezoelectric actuator 1 is activated according to a conventional injection but the cam shaft does not actuate the pump of the pump-nozzle unit. The voltage of the piezoelectric actuator 1 can however also be detected during a normal conveying pulse.

With a control valve 1 that is closed so as to be currentless the charging process of the piezoelectric actuator 1 may be analogously controlled and/or regulated in order to control or regulate partial lifts of the control valve needle 17 for an end of injection.

Figure 6:
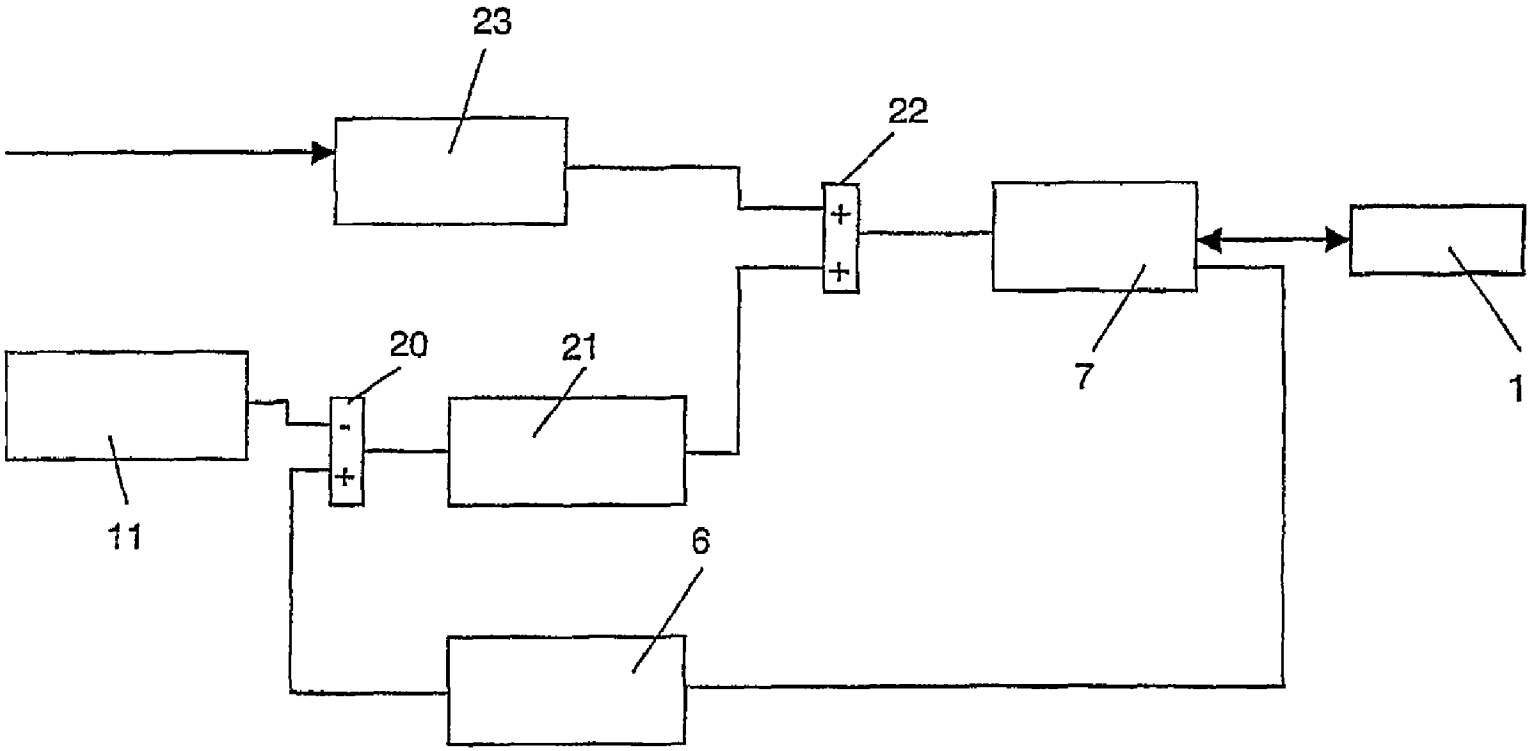
FIG. 6 shows a simply constructed activation circuit for the piezoelectric actuator.

FIG. 6 shows a simple construction of the activation of the piezoelectric actuator 1. A reference gradient is made available as a desired value from the memory 11 and is forwarded to a first adding unit. The first adding unit 20 is supplied with a gradient of the measured voltage of the piezoelectric actuator 1 via a second input. The first adding unit 20 forms the difference between the desired gradient of the memory 11 and the measured gradient of the partial lifting voltage and forwards the different to a first control block 21. From the difference value the first control block 21 determines a control signal for the charging unit 7. The control signal is forwarded from the first control block 21 to a second adding unit 22. A desired control signal is also supplied to a second control block 23. The second control block 23 carries out a compensation with respect to the hysteresis behavior of the piezoelectric actuator 1 and passes a corrected desired control signal to a second input of the second adding unit 22. The second adding unit 22 adds the corrected desired control signal to the control signal and forwards an end control signal to the charging unit 7. From the end control signal the charging unit 7 determines a piezoelectric voltage with which the piezoelectric actuator 1 is activated by, starting from the second voltage U 2, a discharge of the actuator to the third voltage U 3 in the fixed time from the third instant T 3 to the sixth instant T6 is discharged in order to obtain a partial lifting voltage at the actuator 1 during the holding phase, which voltage has a gradient according to the desired gradient. The voltage delivered by the charging unit 7 is also detected and a voltage gradient determined which is forwarded to the first adding unit 20. The described arrangement provides a simple construction of a control unit for carrying out the method according to an embodiment.

The control method which has been described using the example of the control valve needle of the pump-nozzle unit may analogously be applied to control of a servo valve of a common rail injection valve and analogously to the direct control of the nozzle needle of an injection valve, the piezoelectric actuator activating the servo valve or the nozzle needle directly.

In a common rail injection valve a servo valve is activated using the piezoelectric actuator and connects a control chamber to an output chamber. The control chamber is connected by an admission to the pressure accumulator of the common rail. The nozzle needle is moreover pre-tensioned by the pressure in the control chamber onto the associated sealing seat. In the process the nozzle needle directly adjoins, or adjoins via a pressure piston, the control chamber. The nozzle needle also has pressure surfaces in the pressure chamber on which the pressure of the pressure chamber acts and desires to lift the nozzle needle from the sealing seat. The pressure and surface ratios are selected in such a way however that when the servo valve is closed the pressure needle is pressed against the sealing seat so as to be sealed by the pressure in the control chamber. If the control valve is now opened via the piezoelectric actuator, the pressure in the control chamber is reduced since less fuel flows into the control chamber via the admission than flows off via the outflow into the output chamber. The pressure chamber is connected to the pressure accumulator of the common rail. Since the pressure in the pressure chamber does not drop the nozzle needle is lifted from the sealing seat by the fuel pressure in the pressure chamber via the effect on the pressure surfaces. A connection between the pressure chamber and injection holes is thus released. Fuel is thus delivered from the pressure chamber via the injection holes. Injection begins. The servo valve is closed again by activation of the piezoelectric actuator to end injection. The outflow via the output is thus stopped and the pressure in the control chamber increases again. Above a fixed pressure in the control chamber the nozzle needle is pressed onto the sealing seat again against the pressure in the pressure chamber and injection is ended.

Depending on the chosen embodiment a nozzle needle may also be actuated directly by a piezoelectric actuator. This principle can be used in particular with petrol injection valves.

The servo valve in a common rail injection system is activated as a control valve by the described control method and the injection behavior of the injection valve is improved as a result. Similarly there is an improvement in the injection behavior in an injection valve in which the nozzle needle is driven directly by the piezoelectric actuator.

What is claimed is:

1. A method for controlling a piezoelectric actuator which moves a control valve of an injection system, comprising the steps of:

charging the actuator firstly to a starting voltage in order to start an injection via the control valve, subsequently discharging the actuator in order to end the injection via the control valve, wherein the actuator is discharged to a partial lifting voltage during discharging in order to execute a partial lifting control of the control valve and discharging is interrupted during a holding time once the partial voltage is reached, and discharging the actuator to an off-load voltage, wherein a parameter that is dependent on the partial lifting voltage of the actuator during the holding time is used as the desired value for controlling the actuator, and wherein the actuator is activated according to the desired value in order to regulate a partial lift of the control valve.

2. The method according to claim 1, wherein a discharge time that elapses between leaving the starting voltage and attaining the partial lifting voltage is kept constant in successive activation processes of the actuator, and wherein during the transition from the starting voltage to the partial lifting voltage the gradient of the voltage is adjusted accordingly for different starting and/or partial lifting voltages.

3. The method according to claim 1, wherein the partial lifting voltage increases from an initial value during the holding time to an end value, wherein for controlling the actuator the characteristic of the partial lifting voltage during the holding phase is used as a parameter.

4. The method according to claim 3, wherein a maximum voltage value for the partial lifting voltage at the end of the holding phase is used as the desired variable.

5. The method according to claim 1, wherein the gradient of the partial lifting voltage during the holding phase is used as the desired value.

6. The method according to claim 1, wherein the actuator is used for activating a pump-nozzle unit.

7. The method according to claim 6, wherein the voltage values of the actuator are detected as the actual values during a control phase, during which the actuator is activated but no injection is carried out.

8. The method according to claim 1, wherein the partial lifting voltage is used as the parameter, and wherein a frequency of the partial lifting voltage is used as the desired variable.

9. The method according to claim 1, wherein the partial lifting voltage is used as the parameter, and wherein the amplitude and/or the amplitude characteristic of the partial lifting voltage is used as the desired variable.

10. A control unit for controlling a piezoelectric actuator, said control unit being connected to a measurement set-up, wherein the measurement set-up detects the voltage at the actuator, wherein the control unit is connected to a charging unit which influences a charge and/or voltage of the actuator, and wherein the control unit is operable to charge the actuator firstly to a starting voltage in order to start an injection via the control valve, to subsequently discharge the actuator in order to end the injection via the control valve, wherein the actuator is discharged to a partial lifting voltage during discharging in order to execute a partial lifting control of the control valve and discharging is interrupted during a holding time once the partial voltage is reached, and to discharge the actuator to an off-load voltage, wherein a parameter that is dependent on the partial lifting voltage of the actuator during the holding time is used as the desired value for controlling the actuator, and wherein the actuator is activated according to the desired value in order to regulate a partial lift of the control valve.

11. The control unit according to claim 10, wherein the control unit is operable to keep a discharge time that elapses between leaving the starting voltage and attaining the partial lifting voltage constant in successive activation processes of the actuator, and to adjust the gradient of the voltage during the transition from the starting voltage to the partial lifting voltage accordingly for different starting and/or partial lifting voltages.

12. The control unit according to claim 10, wherein the partial lifting voltage increases from an initial value during the holding time to an end value, wherein for controlling the actuator the characteristic of the partial lifting voltage during the holding phase is used as a parameter.

13. The control unit according to claim 12, wherein a maximum voltage value for the partial lifting voltage at the end of the holding phase is used as the desired variable.

14. The control unit according to claim 10, wherein the gradient of the partial lifting voltage during the holding phase is used as the desired value.

15. The control unit according to claim 10, wherein the actuator is used for activating a pump-nozzle unit.

16. The control unit according to claim 15, wherein the voltage values of the actuator are detected as the actual values during a control phase, during which the actuator is activated but no injection is carried out.

17. The control unit according to claim 10, wherein the partial lifting voltage is used as the parameter, and wherein a frequency of the partial lifting voltage is used as the desired variable.

18. The control unit according to claim 10, wherein the partial lifting voltage is used as the parameter, and wherein the amplitude and/or the amplitude characteristic of the partial lifting voltage is used as the desired variable.

* * * * *